US008813714B2

(12) United States Patent
Bak

(10) Patent No.: US 8,813,714 B2
(45) Date of Patent: Aug. 26, 2014

(54) LUBRICATION OF CYLINDERS OF LARGE DIESEL ENGINES, SUCH AS MARINE ENGINES

(75) Inventor: Peer Bak, Sæby (DK)

(73) Assignee: Hans Jensen Lubricators A/S, Hadsund (DK)

( * ) Notice: Subject to any disclaimer, the term of this patent is extended or adjusted under 35 U.S.C. 154(b) by 436 days.

(21) Appl. No.: 13/380,524

(22) PCT Filed: Jun. 18, 2010

(86) PCT No.: PCT/DK2010/050150
§ 371 (c)(1),
(2), (4) Date: Feb. 1, 2012

(87) PCT Pub. No.: WO2010/149162
PCT Pub. Date: Dec. 29, 2010

(65) Prior Publication Data

US 2012/0118260 A1 May 17, 2012

(30) Foreign Application Priority Data

Jun. 23, 2009 (DK) ..... 2009 00774

(51) Int. Cl.
*F01M 11/02* (2006.01)

(52) U.S. Cl.
USPC ..... 123/196 R; 123/73 AD; 123/90.33; 123/190.13; 123/196 CP; 184/6.8; 184/6.5; 184/55.1; 440/88 C

(58) Field of Classification Search
USPC ..... 123/196 R, 196 CP, 90.33, 190.13; 184/6.5, 6.8, 55.1; 440/88 C
See application file for complete search history.

(56) References Cited

U.S. PATENT DOCUMENTS

| | | | | |
|---|---|---|---|---|
| 1,630,547 | A * | 5/1927 | Tartrais | 184/18 |
| 5,002,025 | A * | 3/1991 | Crouse | 123/196 M |
| 6,058,900 | A | 5/2000 | Kusche | |
| 6,227,167 | B1 | 5/2001 | Smith | |
| 6,543,424 | B1 | 4/2003 | Yamaguchi | |
| 6,547,038 | B1 * | 4/2003 | Thomsen et al. | 184/6.8 |
| 6,928,975 | B2 * | 8/2005 | Lauritsen | 123/196 R |
| 7,171,451 | B2 | 1/2007 | Defosse | |
| 7,464,883 | B2 * | 12/2008 | Eriksen et al. | 239/533.1 |
| 7,681,548 | B2 * | 3/2010 | Aamand | 123/196 R |

(Continued)

FOREIGN PATENT DOCUMENTS

| | | |
|---|---|---|
| CH | 673506 | 3/1990 |
| DE | 10149125 A1 | 4/2003 |

(Continued)

*Primary Examiner* — Marguerite McMahon
*Assistant Examiner* — James Kim
(74) *Attorney, Agent, or Firm* — James Creighton Wray

(57) ABSTRACT

There is disclosed a method for cylinder lubrication of large diesel engines, such as marine engines. Injection of lubricating oil is performed via a number of injection units that correspond to a multiple of the cylinder number in the engine. There is desired an efficient distribution of the lubricating oil, not only across the periphery of the cylinder, but also across the travel of the piston in the cylinder in order thereby to reduce the consumption of lubricating oil. This is achieved in that lubricating oil is supplied by a combination of injection of a first part of the lubricating oil directly on a ring area of the cylinder wall before the passage of the piston and an injection of a second part of the lubricating oil directly onto the piston during its passage.

16 Claims, 11 Drawing Sheets

(56) References Cited

U.S. PATENT DOCUMENTS

| | | | | |
|---|---|---|---|---|
| 8,210,317 | B2 * | 7/2012 | Aamand | 184/6.8 |
| 2004/0026174 | A1 | 2/2004 | Lauritsen | |
| 2010/0162989 | A1 | 7/2010 | Aamand | |

FOREIGN PATENT DOCUMENTS

| | | | |
|---|---|---|---|
| DK | 173512 | A | 12/1999 |
| DK | 176129 | A | 11/2002 |
| EP | 0368430 | | 5/1990 |
| EP | 1350929 | | 10/2003 |
| EP | 1350929 | A1 | 10/2003 |
| EP | 1426571 | A2 | 6/2004 |
| EP | 1582706 | | 10/2005 |
| EP | 2044300 | A1 | 4/2009 |
| WO | 9220909 | | 11/1992 |
| WO | 0028194 | | 5/2000 |
| WO | 2007057027 | | 5/2007 |
| WO | 2008009291 | A1 | 1/2008 |
| WO | 2008141650 | A1 | 11/2008 |

* cited by examiner

LUBRICATION OF CYLINDERS OF LARGE DIESEL ENGINES, SUCH AS MARINE ENGINES

This application claims the benefit of Danish Application No. PA 2009 00774 filed Jun. 23, 2009 and PCT/DK2010/050150 filed Jun. 18, 2010, International Publication Number WO 2010/149162 A1 and the amendments filed with the Demand, which are hereby incorporated by reference in their entirety as if fully set forth herein.

FIELD OF THE INVENTION

The present invention concerns a method for lubricating cylinders in large diesel engines, such as marine engines, where injection of lubricating oil is performed via a number of injection units corresponding to a multiple of the cylinder number in the engine, where the lubricating oil is supplied as a combination of injection of at least two parts of the lubricating oil, where said at least two parts of lubricating oil is delivered at least two different piston positions, where the at least two different piston positions are selected among piston positions for injecting before, during and after the passage of the piston by the injection unit, and where at least part of the lubricating oil is supplied by injection directly on a ring area of the wall of the cylinder wherein the lubricating oil is supplied by a combination of injection of a first part of the lubricating oil above the piston directly on a ring area of the cylinder wall before the passage of the piston, and an injection of a second and/or third part of the lubricating oil, as the second part of the lubricating oil is injected directly on the piston during its passage, and as a third part of the lubricating oil is injected directly on a ring area of the cylinder wall under the piston after passage of the piston.

BACKGROUND OF THE INVENTION

The background of this application is that, generally described, three different methods are used today for cylinder lubrication.

A first method comprises conventional cylinder lubrication.

For this is used a system with mechanical lubricating apparatuses which are driven directly via the chain drive of the engine. Synchronous operation of lubricating apparatus and engine is hereby achieved. Such a system typically consists of mechanical lubricating apparatus with a piston pump and associated check valves. At the outlet of the lubricating apparatus, a check valve is provided which through a lubricating oil tube is coupled to an injecting unit (injector/check valve). In this type of system, the oil is supplied to the cylinder immediately before the uppermost piston ring of the piston passes the injection unit. Lubricating oil is typically supplied to the cylinder by each engine stroke.

In these conventional cylinder lubricating apparatuses, mainly for large two-stroke diesel engines, two or more central lubricating apparatuses are used, each providing lubrication at points in a single or a plurality of cylinders, i.e. by feeding portions of oil under pressure through respective connecting lines to the various points to be lubricated at relevant time intervals. These relevant intervals may typically be when the piston rings are provided opposite the relevant point of lubrication during the compression stroke when the piston is moving upwards.

A second method for cylinder lubrication appears on more recent engines and is described as high-speed cylinder lubrication.

Hydraulically powered lubricating apparatuses are used for this purpose where the mechanical chain drive is substituted by a hydraulic system which is timed via timing sensors mounted directly on the flywheel of the marine engine. By this kind of cylinder lubrication, a piston pump is typically used as well. In this kind of system, the lubricating oil is fed into the cylinder simultaneously with the passage of the piston such that largely all the lubricating oil is supplied directly onto the piston, typically between the uppermost and the lowermost piston ring. When the lubricating oil is supplied between the piston rings, it is expected that they retain the lubricating oil better and that the piston subsequently distributes the oil along the travel path of the piston. There are also systems as e.g. disclosed in WO 2008/009291 where hydraulically powered apparatuses are used, where both the injected amount and the timing for delivery of the latter may be adjusted.

The lubricating oil is supplied intermittently such that the amount is adjusted on the basis of the frequency of activation of the piston pump as the stroke of the piston pump is constant. The lubricating oil is supplied by these systems via an injection unit that includes a traditional check valve, injector or an atomising valve. Examples of this technique are known from e.g. DK 173 512 or DE 101 49 125.

There are variants of this high-speed lubrication. Thus is provided a system where the piston pump principle is not used. Instead, the injected amount of lubricating oil is controlled by controlling the opening and closing time. An example of this technique is known from e.g. EP 1 426 571.

The injection may occur by the passage of the piston in upward or downward direction. If this occurs during the downward movement, the oil is distributed on the cylinder face from the point to the lubricated and down in the cylinder lining. However, it is preferred to perform the injection during the upward passage of the piston against the hot end of the cylinder where the need for lubrication is the greatest.

The traditional way by which oil is distributed across the cylinder surface is by establishing two inclining grooves or slots at each point to be lubricated on the cylinder surface, where both grooves or slots initiate from the lubrication point and are directed away from the top of the cylinder. When a piston ring passes such a slot, a drop of pressure occurs in the slot across the piston ring which presses the oil away from the lubrication point. These and other methods, however, have appeared insufficient in that in practice there is observed a substantial variation in the wear occurring along the periphery of the cylinder.

The development towards still greater utilisation of the engines have resulted in an increased mechanical and thermal load on cylinder linings and piston rings, which is traditionally enabled by an increase in the dosing of lubricating oil. However, it has appeared that if the dosing is increased above a certain limit which is not unambiguously defined, the speed of the oil when injected into the cylinder with the mentioned traditional lubrication is so high that instead of remaining on the cylinder face, it forms a jet into the cylinder cavity and thereby disappears. If the dosing is performed as desired while the piston rings are disposed opposite the lubricating units, it is not so critical, but if the dosing occurs outside this period, there are no benefits from a part of the dosed oil.

The two above mentioned methods may also be said to concern a system where lubrication is established by piston distribution of the lubricating oil.

A third method for cylinder lubrication uses systems that feed the lubricating oil directly into the cylinder, directly onto the cylinder wall and before passage of the piston.

In these systems an injector is used which either supplies the lubricating oil in atomised form or in the shape of one or more compact jets. For supplying the lubricating oil to the injector, either a traditionally mechanically driven lubricating apparatus or a hydraulic apparatus is used.

The advantage of this method is that the lubricating oil is already largely distributed on the cylinder wall before passage of the piston. According to this method, the oil is distributed at the top of the cylinder before arrival of the piston, and it is expected that the piston during the expansion stroke carries lubricating oil down into the cylinder. Examples of this technique are known from e.g. WO 0028194, EP 1 350 929 or DK 176 129.

In EP 1 350 929 is described a method where lubricating oil jets—where atomisation of the lubricating oil is avoided to the greatest extent—can be delivered to the cylinder face by injection before, during and/or after passage of the piston. This means that the total amount of lubricating oil is injected onto the cylinder face in at least two parts as indicated in the introduction.

Since the cylinder wall is supplied with oil before passage of the piston, the timing is not so important by this third method as by the two first mentioned systems where the oil is to be supplied exactly in the course of the very short interval when the piston rings are situated opposite the lubricating unit.

Examination has shown that cylinder lubrication according to WO 0028194, so-called SIP lubrication, provides the highest oil film thickness in the cylinder where the wear is the greatest, corresponding to the piston being in top position and in the area of the uppermost piston ring. In contrast to this it has appeared that conventional lubrication or high-speed lubrication provides a thicker oil film on the rest of the travel surface.

The pressure existing by SIP lubrication is required in the lubricating oil lines between pumps and nozzles in order to ensure that the intended atomisation is considerably higher than the pressure by the conventional lubricating methods which operate with pressures of a few bars. SIP valves operate at a preset pressure of 35-40 bars.

The supplying of lubricating oil has furthermore the purpose of neutralising the acid action on the cylinder wall. The acid action arises by combustion of sulphur-containing fuels and they are best counteracted by supplying the lubricating oil directly at the top of the cylinder. Measurements shown that the SIP lubrication provides the least wear. In practice it appears that corrosive wear is the most critical factor for the service life of a cylinder.

A drawback of conventional lubrication or high-speed lubrication, which both are systems that mainly use the piston for distributing the lubricating oil, is that a certain excessive lubrication is needed in order to ensure sufficient lubricating oil for the top of the cylinder. In particular lubrication on the piston requires an increase of the amount of lubricating oil in relation to the sulphur content of the fuel in order to achieve satisfactory cylinder conditions.

Correspondingly, for lubrication with systems where the lubricating oil is fed directly onto the cylinder wall it may be a disadvantage that an insufficient amount of oil is provided at the bottom of the cylinder when applying an amount of lubricating oil sufficient for obviating corrosive wear. This is due to the fact that the piston rings, besides the above mentioned distributing function, also produce a certain scraping action. Measurements show that SIP lubrication produce less scraping down of lubricating oil than lubrication with piston-distributed lubricating oil.

Another difference of lubricating with systems where the lubricating oil is supplied directly to the cylinder wall and piston-distributed lubrication is a consequence of different amounts of lubricating oil being provided down in the cylinder. The scavenge drain oil is thus measurably less by SIP lubrication (according to WO 0028194) than by systems with piston-distributed lubrication where it is only the piston that distributes the lubricating oil. This means that one of the parameters used for assessing the cylinder condition—namely measurement of Fe-content in the scavenge drain oil—cannot be used directly by comparing the cylinder condition since the same Fe-content will give rise to a concentration that varies depending on the lubrication method.

The scavenge air apertures in longitudinally scavenged two-stroke diesel engines are disposed in such a way that during scavenging, a rotational movement of the gas mixture is started simultaneously with the gas being displaced upwards in the cylinder, leaving it through the exhaust valve at the top of the cylinder. The gas in the cylinder thus follows a helical path or whirl on its way from the scavenge air apertures to the exhaust valve. Due to the centrifugal force, a sufficiently small oil particle located in this whirl will be forced out against the cylinder wall, eventually becoming deposited on the wall. This effect is utilised by introducing the oil portions into the cylinder as a mist of oil particles of suitable size, atomised through nozzles. By adjusting the size of the nozzles, the ejection speed and pressure of the oil before the nozzles, it is possible to control the average size of the oil droplets in the oil mist. If an oil particle or oil droplet is too small, it will "float" too long in the gas stream, eventually being moved away by the scavenging air without hitting the cylinder wall. If it is too large, it will continue too far in its initial path due to its inertia and not reach the cylinder wall, which is due to it being overtaken by the piston and positioned at the top of the piston.

The orientation of the nozzles relative to the flow in the cylinder may be arranged such that the interaction between individual droplets and the gas stream in the cylinder ensures that the oil droplets hit the cylinder wall over an area largely corresponding to the circumferential distance between two lubricating points. In this way, the oil is even distributed more or less uniformly across the cylinder surface before the passage of the piston rings. Besides, the nozzle may be adjusted such that the oil hits the cylinder wall higher up than the nozzles. Thus, before being introduced into the cylinder, the oil will not only be better distributed across the cylinder surface, but will also be distributed on the cylinder surface closer to the top the cylinder where the need for lubrication is the greatest. Both of these facts will result in improved utilisation of the oil with assumed improvement of the relation between the service life of the cylinder and the oil consumption.

The supply of oil to the cylinder surface is to be effected in measured portions which is almost the case with the two previously mentioned traditional systems. The supply means can be traditional lubricating systems, but other supply means with corresponding properties may also be envisaged.

In order to ensure that the pressure in the cylinder does not go backwards in the oil line, a check valve is arranged in a normal way at the end of the lubrication line immediately before the lining of the inner cylinder face. The check valve allows the oil to pass from the oil line to the cylinder lining, but does not let gas pass in the opposite direction. These check valves usually have a modest opening pressure (a few bars).

Characteristics of the three above mentioned methods for lubricating cylinders are:

Lubrication timing—when is the lubricating oil supplied in the engine cycle?

Supply amount—how is the relative injected amount adjusted?

Pump characteristic—how and how fast is the lubricating oil supplied?

It is relevant to look for methods of minimising the lubricating oil consumption by providing an improvement of the cylinder lubrication of large diesel engines, such as marine engines.

OBJECT OF THE INVENTION

It is therefore the object of the present invention to indicate a method of the type specified in the introduction wherein an efficient distribution of the lubricating oil is achieved, not only across the periphery of the cylinder but also along the travel path of the piston in the cylinder in order thereby to reduce the lubricating oil consumption and/or to reduce the wear in the entire cylinder.

DESCRIPTION OF THE INVENTION

According to the present invention, this is achieved by a method of the type specified in the introduction which is peculiar in that detection of an indirect or direct parameter for actual cylinder load is performed, and that a distribution between the first and second and/or third parts of the lubricating oil is made such that the second and/or third parts are increased proportionally by reduced cylinder load.

It is to be noted that by high pressure is meant pressure existing in preset SIP valves, e.g. of 35-40 bars as mentioned above. Higher pressure may also be used, however.

Alternatively, the lubricating oil may be supplied at low pressure for establishing a compact jet of lubricating oil.

There are several possible alternatives for performing such a control of the oil injection, depending on operational parameters.

There may be used a system which via sensors in the cylinder wall measures wear (e.g. indirectly in the form of temperature measurements), and on the basis of this varies the distribution between lubricating oil supplied as the first or the second part (or possibly also as a third part for delivery after passage of the piston). The first part can be supplied as SIP lubrication and the second part can be supplied according to the traditionally timed systems. This means that apart from enabling adjusting the amount of lubricating oil, one may also use a parameter for relative distribution of the lubricating oil according to one or the other principle, e.g. as a consequence of detecting increased wear.

Alternatively, there may be used a system wherein adjustment occurs according to a distribution among first, second and third parts (and thereby the lubricating oil distribution) which via one or more sensors use a direct or indirect measurement of cylinder condition as parameter. For example revolutions, cylinder lining temperature, load, injected fuel amount, lubricating oil quality, lubricating oil viscosity, TBN content of lubricating oil, analysis results for scavenge drain oil (residual TBN, Fe-content etc.). There may be applied a system which e.g. uses sulphur measurements in the fuel oil. Increased sulphur contents require more lubricating oil for neutralising the sulphur. The method according to the invention may therefore be adapted such that an improved neutralisation relationship may be achieved farther down in the cylinder at a position under the lubricating oil injectors of the injection units by switching between the two lubrication principles. Here is referred to the principle illustrated in FIG. 11. In that way the neutralisation conditions above and under the injection units become more uniform.

Alternatively, it is possible to use the area ratio above and under the injection units for calculating a minimum amount supplied on the pistons. Here, it is important to note that the load, including piston speed, temperature, compression and combustion pressure, is typically the highest at the top of the cylinder. This means that it is not possible only to use the area relationship as a parameter. The distribution, and the basis of the latter, is then i.a. found as a function of the area conditions in the cylinder.

Alternatively, one may determine the minimum amount of lubricating oil to be supplied on the piston, either on the basis of the whole area of the cylinder lining or exclusively on the basis of the area under the injection units. The distribution, and the basis of the latter, is then i.a. found as a function of the area conditions in the cylinder, possibly combined with some of the other parameters.

Alternatively, one may use analysis of scavenge drain oil as an active control parameter. Analysis of the drain oil may either be performed online or manually. There may be provided a closed-circuit regulation where the control automatically tries to reduce wear particles in the first place. Wear particles may e.g. be represented by the number of Fe particles. If this does not improve the measurements within a given time-period, one may instead either increase the lubricating oil amount or increase the amount and distribution key.

Alternatively, one may use analysis of online measurement of residual TBN either directly for adjusting distribution or as a combination of increased lubricating oil amount and a change of the distribution.

As mentioned previously, one will typically use a distribution for supplying onto the piston or above the piston, but as an alternative to this one may also combine the above embodiments with a system where some of the lubricating oil amount is supplied under the piston. Thereby the amount of oil "coming down" into the cylinder may be increased.

The at least two parts of the lubricating oil is supplied preferably according to a principle where lubricating oil is supplied only once in each engine cycle. This means that the first part of the lubricating oil is supplied in one engine cycle and the second part of the lubricating oil is supplied in another engine cycle, and so on. Alternatively, it will also be possible that all parts of the lubricating oil are supplied in one and the same engine cycle.

When a combination of several parts of the lubricating oil is used, an adjustment of the control is to occur such that algorithms are produced which are based on injection of three partial amounts of the lubricating oil at different lubricating times.

By the present invention is thus applied a combination of prior art methods for cylinder lubrication such that it is possible to achieve the advantages of each principle and at the same time avoid the drawbacks.

Supplying directly on a ring area may occur in the form of atomisation or in the form of a compact oil jet.

Supply of lubricating oil occurs via lubricating oil injectors that constitute part of the injection units and which are provided in the cylinder wall.

Basically, there is thus used a combination of injection of a first part of the lubricating oil into the cylinder, directly onto the cylinder wall and before the passage of the piston, such that this first part of the lubricating oil is already substantially distributed on the cylinder wall before passage of the piston such that a better cylinder condition above the injection units is achieved, and an injection of a second part of the lubricating oil by conventional lubrication with piston distribution of the lubricating oil such that an increased average oil film thickness is attained under the injection units.

The cylinder conditions hereby become better in the area at the top of the cylinder as well as in the area under the injection units.

The advantage of this combination is that wear is minimised and at the same time the lubricating oil consumption is minimised as it is possible to operate with the least possible feed rate. In total, a better functioning method is achieved where the best is taken from all systems and combined into a new system.

The distribution among the lubricating oil amounts for the first and second and/or third part of the lubricating oil as well as timing of injection on the piston above/under the piston, respectively, will preferably be parameter-controlled. The actual operation conditions in the cylinder may thus be determining for distribution and timing.

It may be said that a multi-timing cylinder lubrication is achieved combined with a functionally determined cylinder lubrication. It may be applied in different situations, for example by sulphur-dependent distribution of the various parts of the lubricating oil as described below.

By using the method according to the invention, more principal embodiments of application of the method according to the invention are possible:

a) that an electronic control is provided, that the time of oil injecting is used as a parameter for adjusting the distribution of lubricating oil in longitudinal direction of the cylinder, and that the control automatically distributes the different parts of the lubricating oil on the at least two different piston positions. These may be disposed at the same level in the cylinder or at different levels in the cylinder, i.e. by operating with the same injection unit or different injection units for injecting the different parts of lubricating oil.

b) The system mention under a) being peculiar in that a fixed percentage of the lubricating oil is supplied:

On the cylinder piston during its passage of lubricating oil injectors, during either the upward or the downward piston passage.

Directly on the cylinder wall under the piston after the piston having passed the lubricating oil injectors during the upwards movement of the piston.

Directly on the cylinder wall before the cylinder piston passes the lubricating oil injectors during the downwards movement of the cylinder piston.

In these situations, the rest of the lubricating oil (the first part) will be supplied directly onto the cylinder wall above the piston during its upward movement.

c) A system as mentioned under a) being peculiar in that a fixed amount of the lubricating oil is supplied:

On the cylinder piston during its passage of lubricating oil injectors, during either the upward or the downward piston passage.

Directly on the cylinder wall under the piston after the piston having passed the lubricating oil injectors during the upwards movement of the piston.

Directly on the cylinder wall before the cylinder piston passes the lubricating oil injectors during the downwards movement of the cylinder piston.

In these situations, the rest of the lubricating oil (the first part) will be supplied directly onto the cylinder wall above the cylinder piston during its upward movement.

This means that use of another form of regulated distribution of the lubricating oil amount, either by load regulation or by MEP regulation, will become proportional to e.g. the actual load, revolutions, etc.

d) A system as mentioned under a), b) or c), where offline or online wear measurements are performed on the cylinder wall, and which is peculiar in that these wear measurements are used for correcting the distribution among first, second and third parts (and thereby the distribution of lubricating oil).

e) A system as mentioned under any of the above a)-d), where offline or online measurements of oil film thickness are performed on the cylinder wall, and which is peculiar in that these measurements of the oil film thickness are used for correcting the distribution among first, second and third parts (and thereby the distribution of lubricating oil).

f) A system as mentioned under a) which is peculiar in that the distribution between the at least two parts of the lubricating oil is made directly or indirectly depending on the actual sulphur content in the fuel supplied to the cylinder.

The above mentioned principal embodiments a)-f), may be combined with method steps comprising:

I) Regulated Distribution of Lubricating Oil

A load regulated lubricating oil distribution may be applied. Here, a distribution algorithm may be applied, starting with a fixed amount of the total amount of lubricating oil being supplied either on or under the piston. These algorithms may be based on different percentages of distribution between the first part and the second part of the lubricating oil wanted at 100% load. In the same way, it will be possible to change the lubricating oil distribution between the first and the third part. Moreover, it will be possible to establish a lubricating oil distribution where a lubricating oil distribution among first, second and third parts is applied.

These algorithms may be based on the condition of no reduction of the total lubricating oil amount (besides reduction based on change in revolutions), why the distribution is defined as a fixed ratio between the first and the second parts of the lubricating oil amount.

By reduction of the total amount of lubricating oil is applied a distribution algorithm which provides a varied relationship between the first and second parts of the amount of lubricating oil. In the first instance, a given ratio of e.g. 1/10 at 100% load may be used, where 10% of the total amount of lubricating oil is supplied on the piston and 90% is supplied on the cylinder wall above the piston. The distribution between the first and second parts is changed such that a certain amount (corresponding to 1/10 of the stroke of the piston of the dosing pump at 100%) is ensured supplied on the piston. This means that by using a lubricating oil regulation algorithm where the stroke of the pump piston for lubricating oil is changed, compensation has to be made therefor. Regulation of the stroke of the pump piston may thus amount to 25% of the stroke at 25% load. Examples are shown in FIG. 9.

Alternatively, an MEP-regulated lubricating oil distribution may be applied. Here also, a distribution algorithm may be applied, starting with a fixed amount of the total amount of lubricating oil being supplied either on or under the piston. These algorithms may be based on different percentages of distribution between the first part and the second part of the lubricating oil wanted at 100% load.

By reducing the total amount of lubricating oil, by MEP-regulation is applied a distribution algorithm providing a varied relationship between the first and second parts of the amount of lubricating oil. Regulation may occur correspondingly as by load regulation by changing stroke on the pump piston for the lubricating oil. However, typically there is operated with a smaller change of the distribution percentage. In the first instance, a given ratio of 1/10 at 100% load may be used, where 10% of the total amount of lubricating oil is supplied on the piston and 90% is supplied on the cylinder wall above the piston. The distribution percentage at 60% RPM may thus entail a distribution percentage of 15%. Examples are shown in FIG. 10.

II) Corresponding embodiments of fixed or regulated distribution of lubricating oil by intermittent lubrication The above embodiment I presuppose that lubricating oil is supplied in each engine stroke. However, it is possible to use a corresponding solution in lubricating systems with intermittent lubrication. I.e. where lubricating oil is not supplied in each engine stroke.

III) Sulphur-dependent distribution Depending on the sulphur content in the supplied fuel in the cylinder, one may vary the first part of the lubricating oil supplied directly onto the cylinder wall above the piston during its upward movement. By a higher sulphur content, one may thus increase the first part of the lubricating oil supplied directly onto the cylinder wall above the piston during its upward movement. Hereby, the amount of lubricating oil at the top of the cylinder will be increased in order to neutralise the relatively larger amount of acid which is formed due to the higher sulphur content in the supplied fuel.

The level of parameters will be empirically determined. However, in FIG. 11 is shown an example of how a distribution may look like.

It is noted that a fixed percentage part in some situations may be complemented by a variable parameter-dependent part. E.g. a 10% fixed lubrication under the piston may be accomplished with an additional load proportional part that to some degree is changed proportional to the load and which is also injected under the piston.

According to a further embodiment, the method according to the present invention is peculiar in that the injection of the first part of the lubricating oil is effected in connection with an upward piston passage and at a time immediately before the upward piston passage of the ring area. As the lubricating oil delivered from each injection unit is directed against an area of the cylinder wall in the vicinity of each injection unit in a ring area in which the injection units are mounted, the injected lubricating oil will, before the actual piston passage, be in time to form a largely coherent annular lubricating oil film on the cylinder face. The advantages are described more in detail in WO 0028194 and in EP 1 350 929.

According to a further embodiment, the method according to the present invention is peculiar in that the injection of the second part of the lubricating oil is effected in connection with an upward piston passage and in an area between the uppermost and lowermost piston ring of the piston. The piston is hereby lubricated during its upward movement. The optimal procedure is to start supply of lubricating oil when the upper piston ring is in front of the injection unit and to finish when the last piston ring is passing (most pistons have four piston rings).

In some situations, however, it may be necessary make a compromise with the distribution between the piston rings as the injection time is volume-dependent and as the piston speed also varies.

Alternatively, by conventional mechanically powered lubricating apparatuses with check valves one may typically start injection of lubricating oil earlier than the time for passage of the first piston ring such that it is safeguarded that the lubricating oil is in place when the piston is passing.

Alternatively, injection of lubricating oil may be performed during the downward movement of the piston if it appears that there is a greater need than expected for lubricating oil on the lower part of the cylinder wall under the piston. According to a further embodiment, the method according to the invention is peculiar in that the same injection units are used for injecting each of the injected parts of the lubricating oil.

It is possible to use the same injection units as applied in prior art systems. In principle, it is only to be ensured that the injection unit can supply the lubricating oil before, during and possibly also after piston passage. It will not be required to change nozzles/valves in the injection unit, but only in controls embedded in control units such that algorithms are produced that establish different lubricating times and injection amounts/characteristics in dependence of operation parameters, e.g. cylinder load.

According to a further embodiment, the method according to the present invention is peculiar in that injection of the first part of the lubricating oil occurs at high pressure through the injection units for establishing a complete or partial atomisation of the lubricating oil and at a time immediately before the upward piston passage of the ring area. The advantages of SIP lubrication are hereby achieved where the lubricating oil is atomised and the atomised lubricating oil will be in time before the actual piston passage to form a largely coherent annular lubricating oil film on the cylinder face. The advantages are described in more detail in WO 0028194.

According to a further embodiment, the method according to the present invention is peculiar in that injection of the second and/or third part of the lubricating oil occurs at a high pressure through the injection units for establishing a complete or partial atomisation of the lubricating oil. Hereby, oil is provided in recesses in the cylinder wall for subsequently being entrained by the piston ring, or alternatively an atomised spray of oil is formed which is injected on and distributed by the piston.

According to a further embodiment, the method according to the present invention is peculiar in that the second and/or third part of the lubricating oil constitute minimum 10% of the total amount of lubricating oil.

There is a need for defining a certain minimum amount of the lubricating oil to be supplied onto the piston. This minimum amount will be determined by tests, but it will be assumed that as a minimum 10% of the lubricating oil is always supplied directly on the pistons, i.e. as the second part of the lubricating oil.

It is thus possible, as already mentioned above, that a distribution is made based on actual load and/or another kind of direct/indirect parameter indicating cylinder load and/or condition. This distribution may imply that a delivery of lubricating oil directly on the piston will always constitute the smallest percentage of the totally supplied amount of lubricating oil. Also, this distribution may imply that a delivery of lubricating oil above the piston will always constitute the smallest percentage of the totally supplied amount of lubricating oil.

A distribution may be performed proportionally with the actual load. As an example, by 90% load a 90% supply of lubricating oil above the piston may thus be effected, by 60% load a 60% supply of lubricating oil above the piston may be effected, and by 40% load a 40% supply of lubricating oil above the piston may be effected, and so on.

According to a further embodiment, the method according to the present invention is peculiar in that the position and movement of the piston are detected directly or indirectly, and that a timing of delivery of the lubricating oil, an adjustment of the amount of lubricating oil and a determination of injection characteristic are performed.

For example, reference means may be applied which are connected with the main shaft and which directly or indirectly indicate the position of the main shaft and thereby also the position of the piston. These may interact with the sensor means which detect position of the reference means, and a control unit which is connected to and receives signals from the sensor means and which includes means for detecting angular position as well as angular speed of the reference means and thereby of the main shaft, and which is connected with and controls activation of piston pumps for dosing the lubricating oil.

According to a further embodiment, the method according to the present invention is peculiar in that that it includes a computerised controlling, monitoring and/or detecting of the functions of the method. Such a computer control may be used as control unit for regulating the parameters for lubricating oil injection depending on customised algorithms.

The method according to the invention may readily be implemented in a system as described in EP 2 044 300 or alternatively in a system as described in WO 2008/141650. Both of these documents are hereby incorporated by reference.

In the latter system, it is possible that the apparatus may have different strokes. These strokes are controlled by solenoid valves which supply hydraulic oil pressure to a distributor plate. In principle, injection onto the piston may be provided with one solenoid valve and injection above the piston with another solenoid valve.

Alternatively, it will be possible on the basis of the control that the same solenoid valve provides timing at two different times and is thereby used both for injection onto the piston and for injection above the piston.

DESCRIPTION OF THE DRAWING

The invention will now be explained more closely with reference to the accompanying drawing, where.

DETAILED DESCRIPTION OF THE INVENTION

Figure 1:
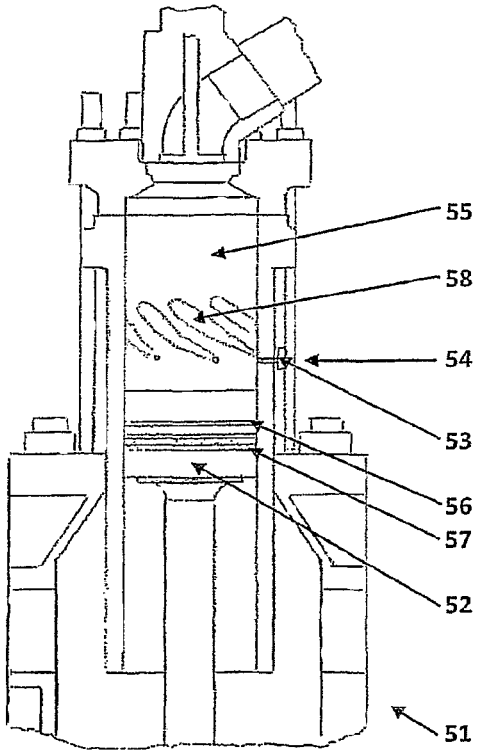
FIG. 1 shows a schematic sectional view through a cylinder where a first part of lubricating oil is injected into the cylinder.
Figure 2:
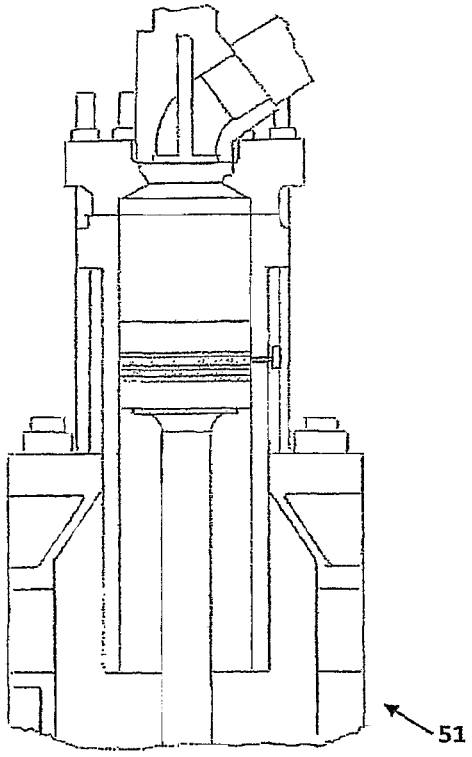
FIG. 2 shows a sectional view corresponding to that of FIG. 1, but where a second part of lubricating oil is injected into the cylinder.
Figure 3:
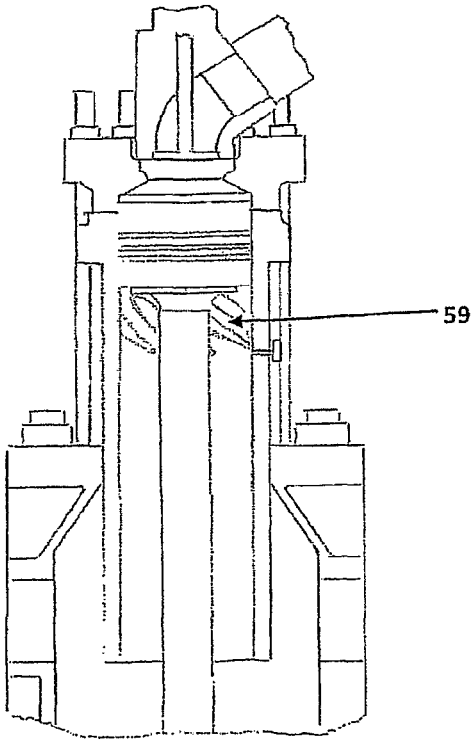
FIG. 3 shows a sectional view corresponding to that of FIG. 1, but where a third part of lubricating oil is injected into the cylinder.

In FIGS. 1 to 3 appears a sectional view through a cylinder 51 with a piston 52 and a number of injection units 53 disposed in a ring area 54 of the cylinder wall 55 and which is connected with a not shown lubricating apparatus.

In FIG. 1, the piston 52 is seen in a lower position. Injection of oil 58 is performed from each injection unit directly on the ring area 54 of the cylinder wall 55. The injection occurs at a position above the piston 52 immediately before the piston during its upward movement passes the ring area 54.

In FIG. 2, the piston 52 is shown in a middle position where the injection units 53 are located at a position between an upper piston ring 56 and a lower piston ring 57. Injection of oil 58 from each injection unit is performed directly onto the piston 52 between the upper piston ring 56 and the lower piston ring 57 during the upward movement of the piston through the ring area 54.

In FIG. 3 the piston 52 appears in an upper position. Injection of oil 59 is performed from each injection unit directly on the ring area 54 of the cylinder wall 55. The injection occurs at a position under the piston 52 immediately before the piston during its upward movement passes the ring area 54.

Figure 4:
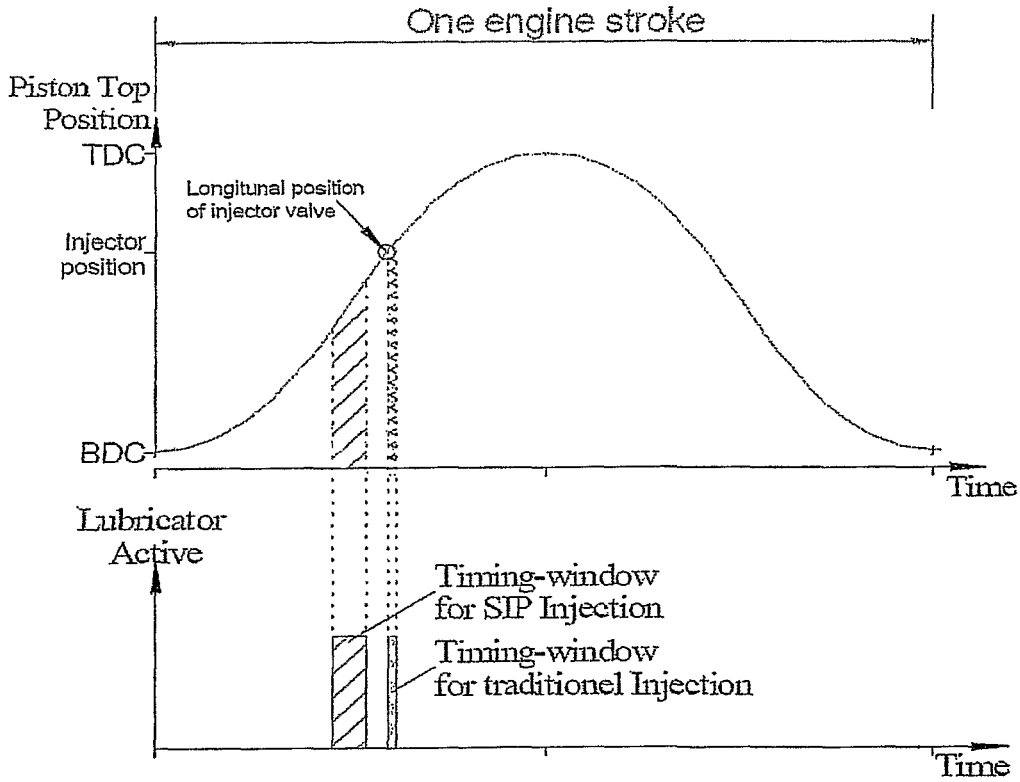
FIG. 4 shows injection timing according to two different principles for injection of the first and the second part of the lubricating oil.

In FIG. 4, the two different lubricating times are shown, depending on being SIP lubrication or traditional lubrication.

In both cases, lubricating oil is delivered into the cylinder during the upward movement of the piston. This means from Bottom Dead Center (BDC) to Top Dead Center (TDC).

The "window" in which we are to time by SIP is placed before the piston passes the lubricating oil injector. The "window" used for traditional lubrication is narrower and, simply expressed, lies after the piston top having passed the lubricating oil injector.

Figure 5A:
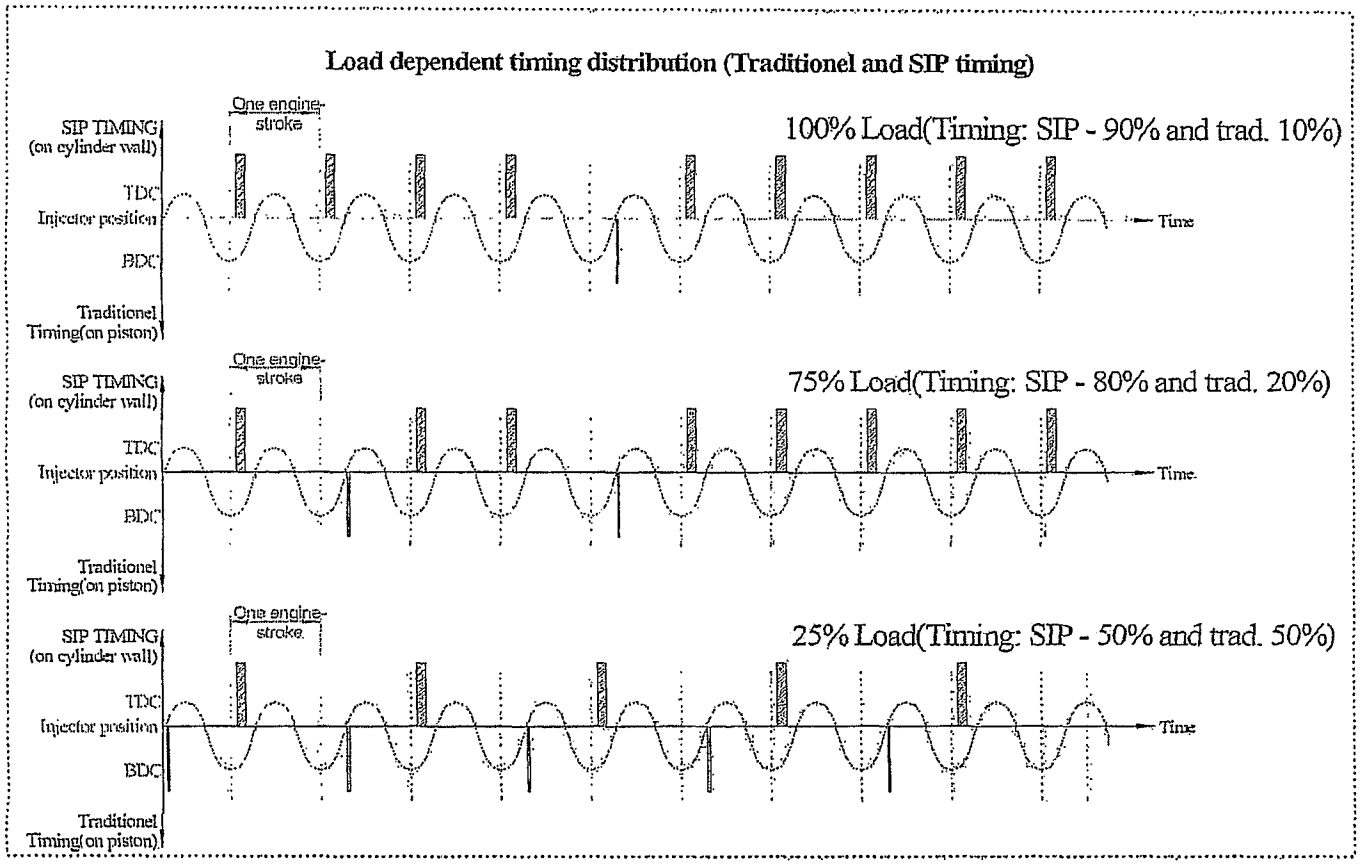
FIGS. 5*a*+5*b* show two possible principles for regulated or fixed distribution of injection of the first and the second part of the lubricating oil.

FIG. 5*a* shows a load dependent lubricating distribution where the distribution between SIP and traditional lubrication is changed such that by low load, lubricating oil is supplied farther down the cylinder wall to a higher degree.

Figure 5B:
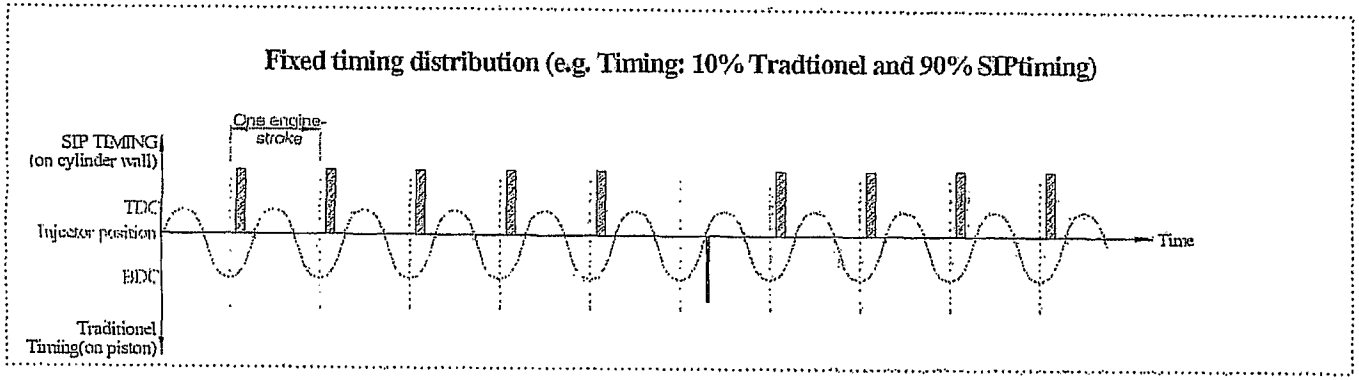

FIG. 5*b* shows a constant lubrication distribution. This means that the distribution between SIP and traditional lubrication is not made dependent on operational parameters. Instead, a fixed distribution key is provided in the control. It is possible concurrently to consider if more lubrication oil is wanted farther down on the cylinder wall. In that case, this will be considered on the basis of measurements of the wear or from a visual inspection of the cylinder wall.

Figure 6:
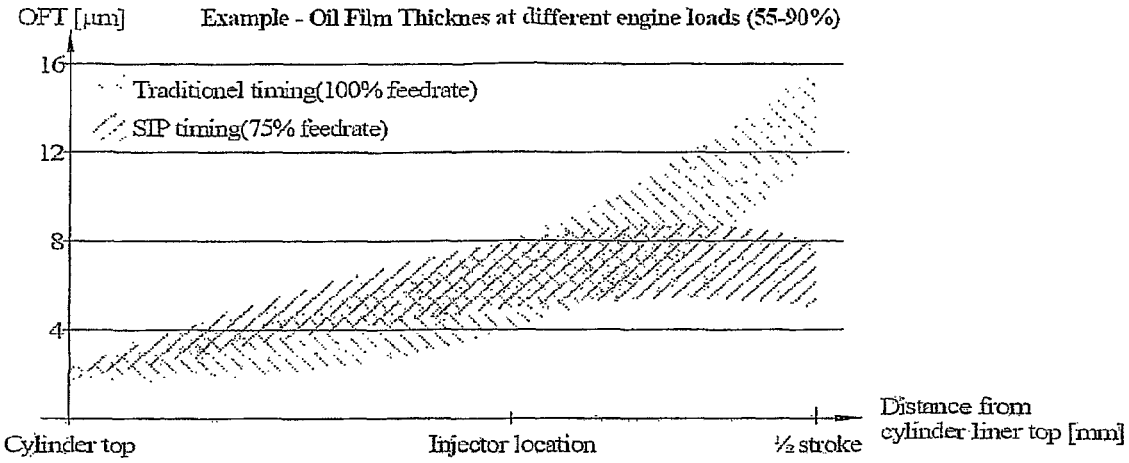
FIG. 6 shows an example of change of the oil film thickness in longitudinal direction of the cylinder.
Figure 6:
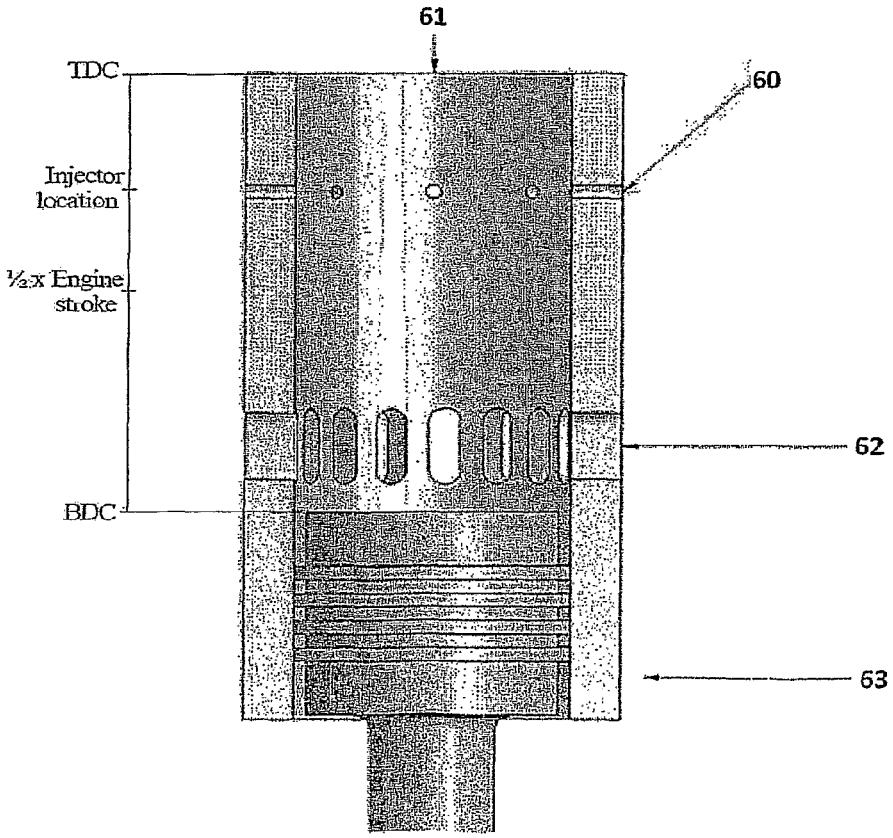

In FIG. 6 is shown an example of how the oil film thickness is changed in longitudinal direction of the cylinder, depending on whether SIP or traditional lubrication is used. I.e. depending on whether using lubrication with injection of the first part of lubricating oil or by injection of the second part of lubricating oil.

In the Figure, the hole 60 of the injection units 3 is shown without machining for an SIP valve. When the piston in operation is at the top position, i.e. closer to the cylinder top 61, the point is called Top Dead Center. At the bottom of the cylinder, the corresponding Bottom Dead Center position 63 is defined, and in this position the scavenge air ports 62 are exposed.

In this Figure, an upper and a lower oil film thickness is shown at different loads and depending on whether it is an SIP or a traditional lubrication. Oil film thickness measurements are made at different loads. The width of the "band" is expressing that the oil film varies to a certain extent at different loads. The Figure shows in principle the oil film both at the highest and at the lowest load.

In the Figure, the SIP valve (also termed lubricating oil injector) is shown. When looking at the area between the cylinder top and the lubricating oil injector it is seen that the oil film in this area is thicker for the SIP lubrication than for the traditional lubrication.

This is to be compared with the fact that the feed rate (amount of supplied oil per power unit) is 25% lower in the shown example. So the tendency is clear.

Looking at the area under the lubricating oil injectors it is further seen that for traditional lubrication, a significantly thicker oil film occurs.

Figure 7:
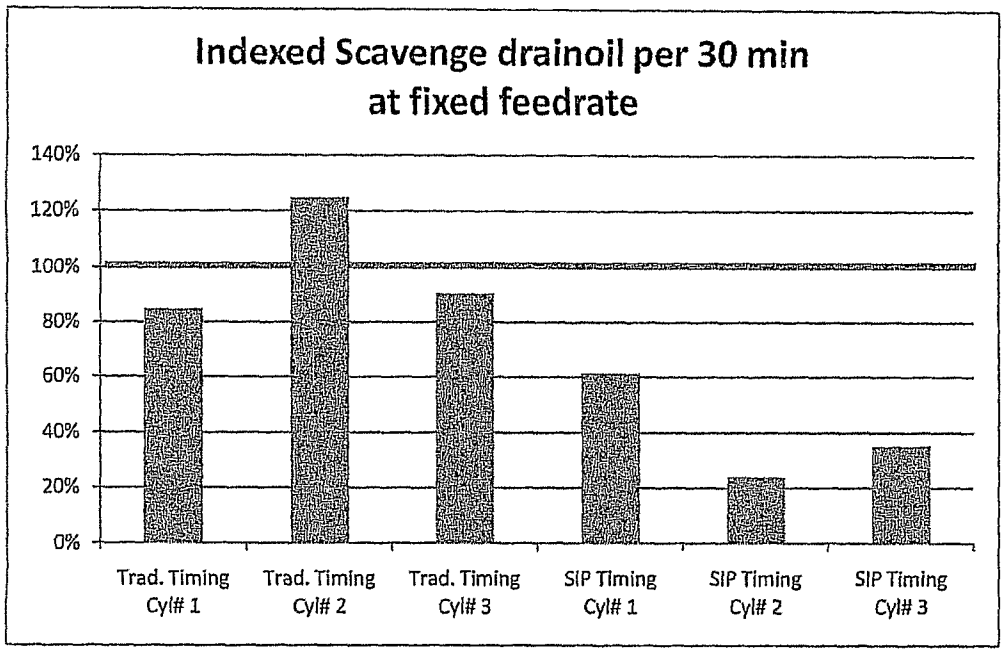
FIG. 7 shows examples of reduction of scavenge drain oil by injection of lubricating oil as the first part of the lubricating oil (SIP principle)

In FIG. 7, a set of examples of reducing scavenge drain oil by injection of lubricating oil as the first part of the lubricating oil (SIP principle) are shown. The values are indexed and come from the same tests as the numbers used originally in FIG. 6. The Figure shows six different cylinders, where the three first columns show cylinders run with traditional timing and where the three last ones are run with SIP timing. From the Figure appears a marked difference in drain oil—the amounts between the three first and the three last cylinder, which in turn shows that lubricating oil supplied as the first part (SIP principle) yields less drain oil.

Figure 8:
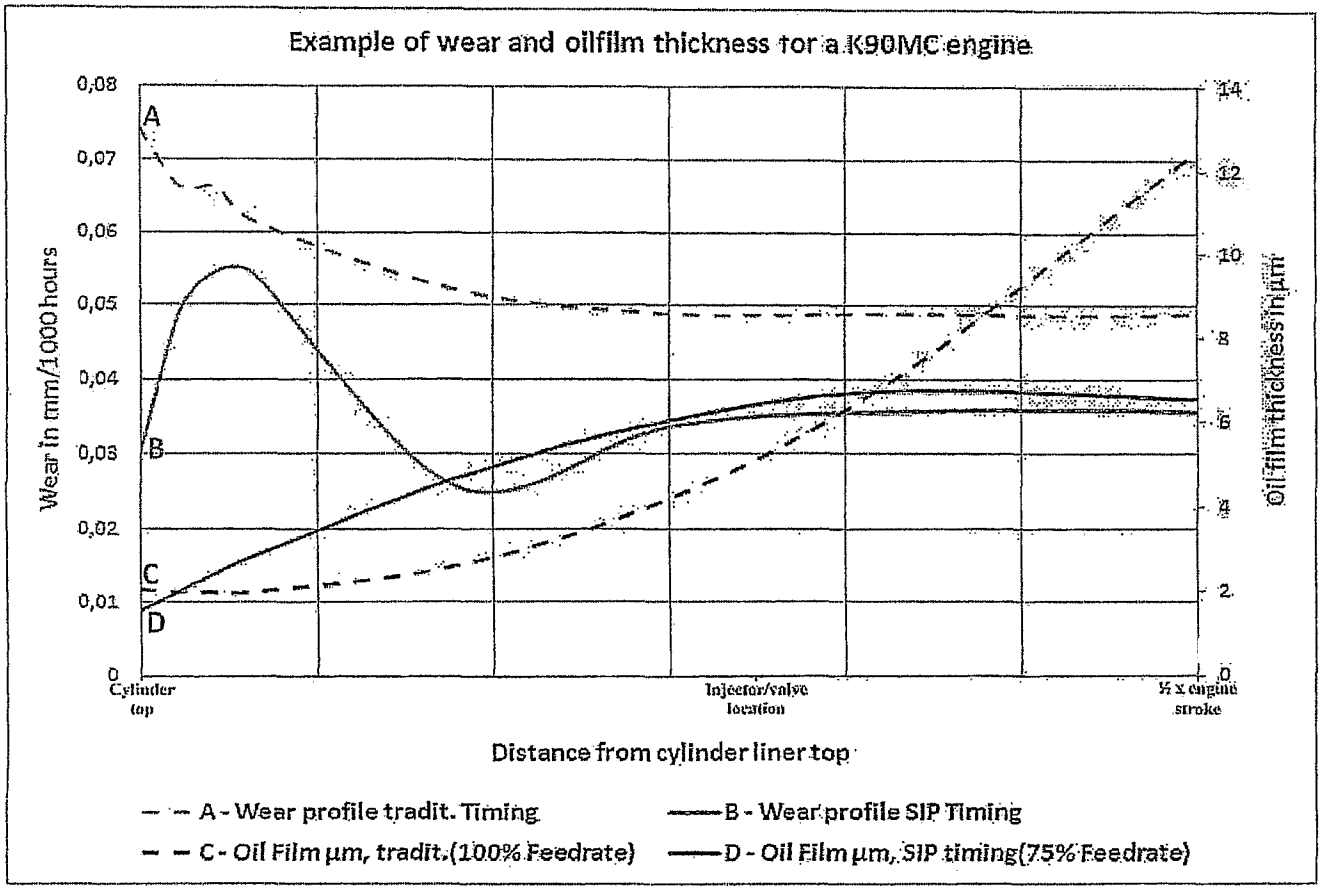
FIG. 8 shows examples of wear progress by injection of lubricating oil either as the first part of the lubricating oil (SIP principle) or as the second part of the lubricating oil (traditional)

In FIG. 8 shows how a cylinder is worn differently in longitudinal direction when SIP lubrication is used. In this Figure, a combination with an average oil film thickness is made for indicating the relationship between the oil film thickness and the wear.

In the Figure, the broken lines show traditional lubrication and the solid lines show SIP lubrication. The two upper curves A and B indicate wear rates per 1000 hours, and the two lower curves C and D indicate an average of the values shown in FIG. 6. At the same time, the Figure indicates that SIP lubrication generally reduces the wear level.

Figure 9:
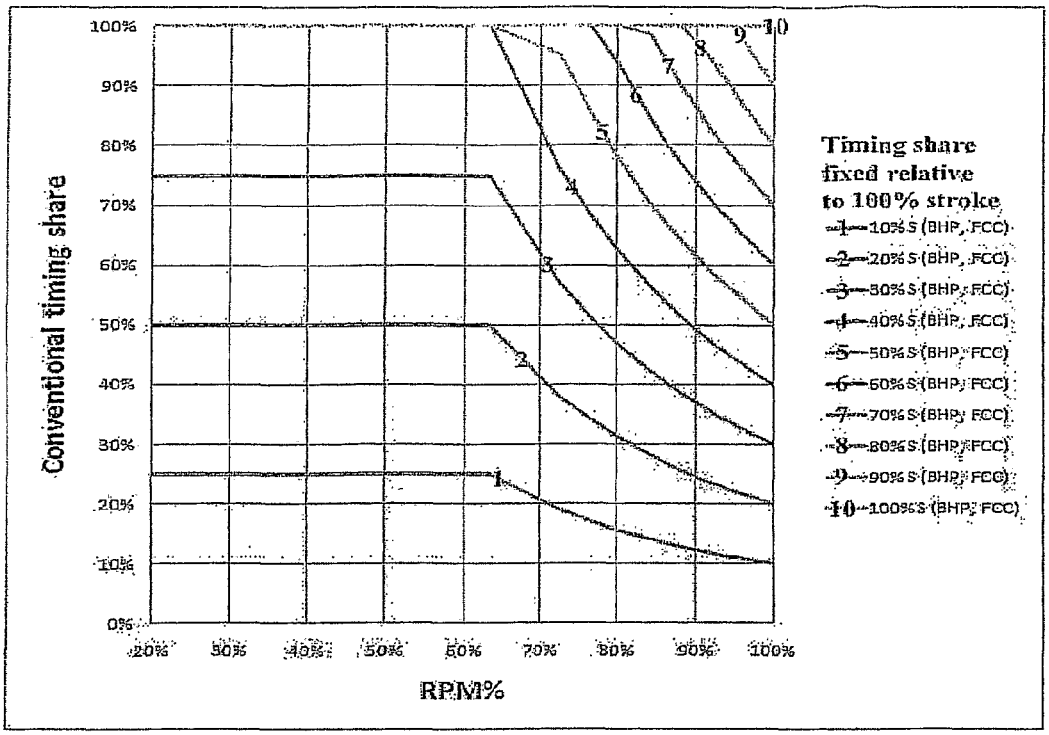
FIG. 9 shows a distribution algorithm with fixed amount of lubricating oil supplied as second or third part of the lubricating oil (on or under the piston) compared with a load regulated lubricating oil amount.

FIG. 9 shows a distribution algorithm starting with a fixed amount of lubricating oil being supplied either on or under the piston. The different lines numbered 1 to 10 show which distribution percentage is desired at 100% load.

It appears from the Figure e.g. that by the line marked "2" in the Figure, a fixed part (by 100% engine load) of 20% of the total stroke is supplied either as second or third part. At the same time, the Figure presupposes application of load regulation of the lubricating oil amount. This means that the total stroke is reduced when operating with engine loads below 100%. For example, by 50% engine load only 50% of the amount of lubricating oil is used by full load. A load regulated lubricating oil amount then means that by a defined fixed amount to be delivered as a second or third part, the lubricating oil distribution will take account of this. In the example with a fixed part of 20% of the total stroke by 100% engine load, this means that the lubricating oil distribution is changed such that up to 50% of the lubricating oil is delivered as a second or third part.

If operating without any reduction of the amount of lubricating oil (besides reduction in revolutions), the fixed amount of the oil supplied either on or under the piston may be defined as a fixed part indicated by a constant percentage value.

Figure 10:
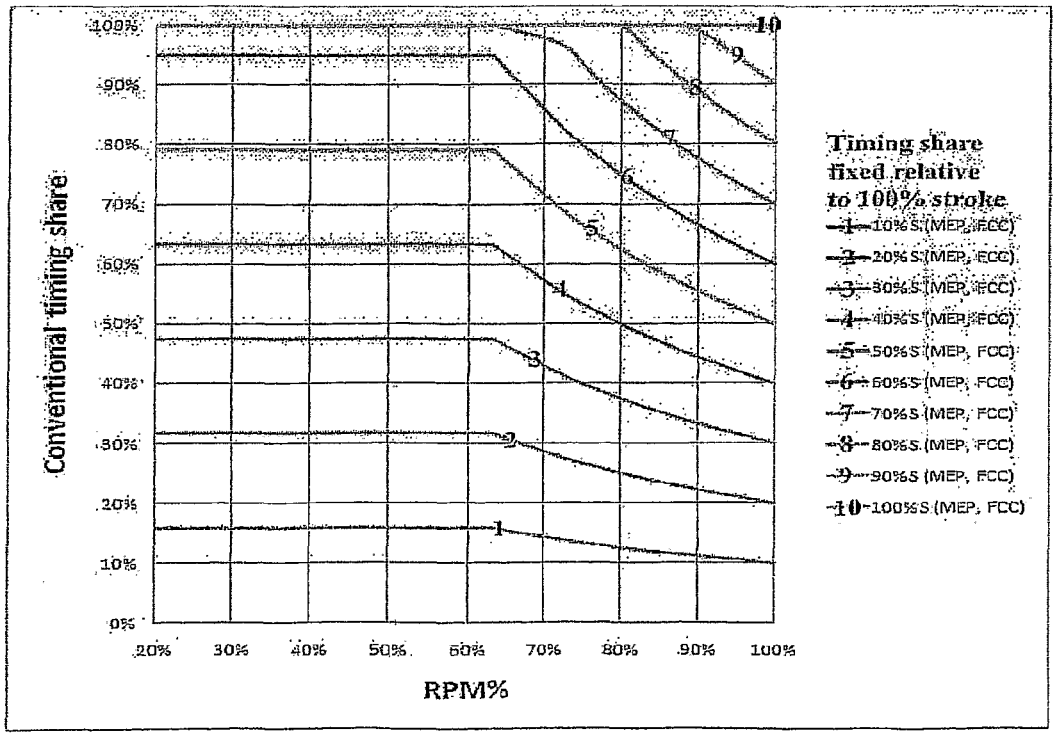
FIG. 10 shows an alternative distribution algorithm with fixed amount of lubricating oil supplied as second or third part of the lubricating oil (on or under the piston) compared with a so-called MEP regulated lubricating oil amount.

FIG. 10 shows a different distribution algorithm. Here, basis is taken in keeping the fixed part of the lubricating oil supplied either on or under the piston, and correction is made after proportionally reducing the lubrication oil amount by a so-called MEP regulation.

It appears that the MEP regulation according to the curves shown in FIG. 10 implies a small change of the percentage distribution.

Figure 11:
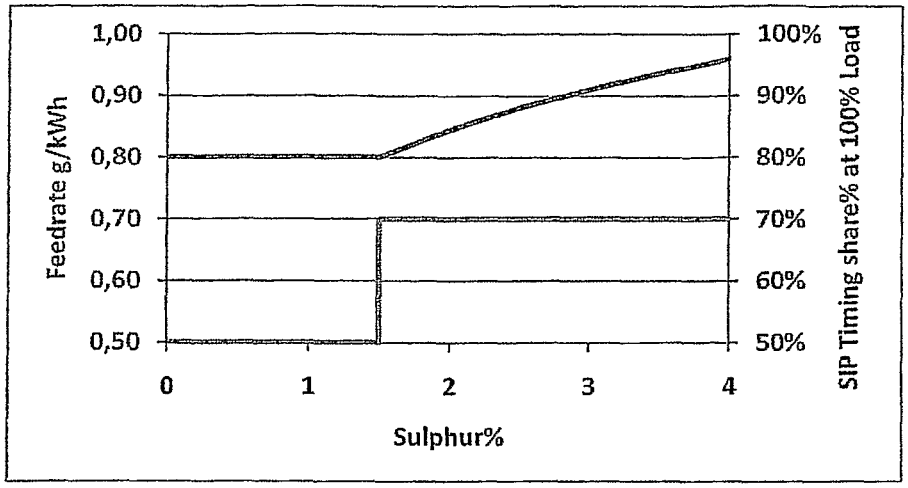
FIG. 11 shows an example of a distribution algorithm by different sulphur contents in the fuel supplied to the engine.

FIG. 11 shows an example of a distribution algorithm by different sulphur contents in the fuel supplied to the engine; Depending on the sulphur content in the supplied fuel, one may vary the first part of the lubricating oil, i.e. the part of lubricating oil supplied directly onto the cylinder wall above the piston during its upward movement. The variation may be performed such that by a higher sulphur content, the first part of the lubricating oil supplied directly onto the cylinder wall above the piston during its upward movement is increased. In this way, the amount of lubricating oil at the top of the cylinder is increased such that improved neutralisation of the relatively larger amount of acid formed due to the higher sulphur content in the supplied fuel is achieved. In the Figure, two different lubricating oil feed rates are shown, but the change of the lubricating oil distribution may be effected both depending on the lubricating oil feed rate and independently of the same.

Figure 12:
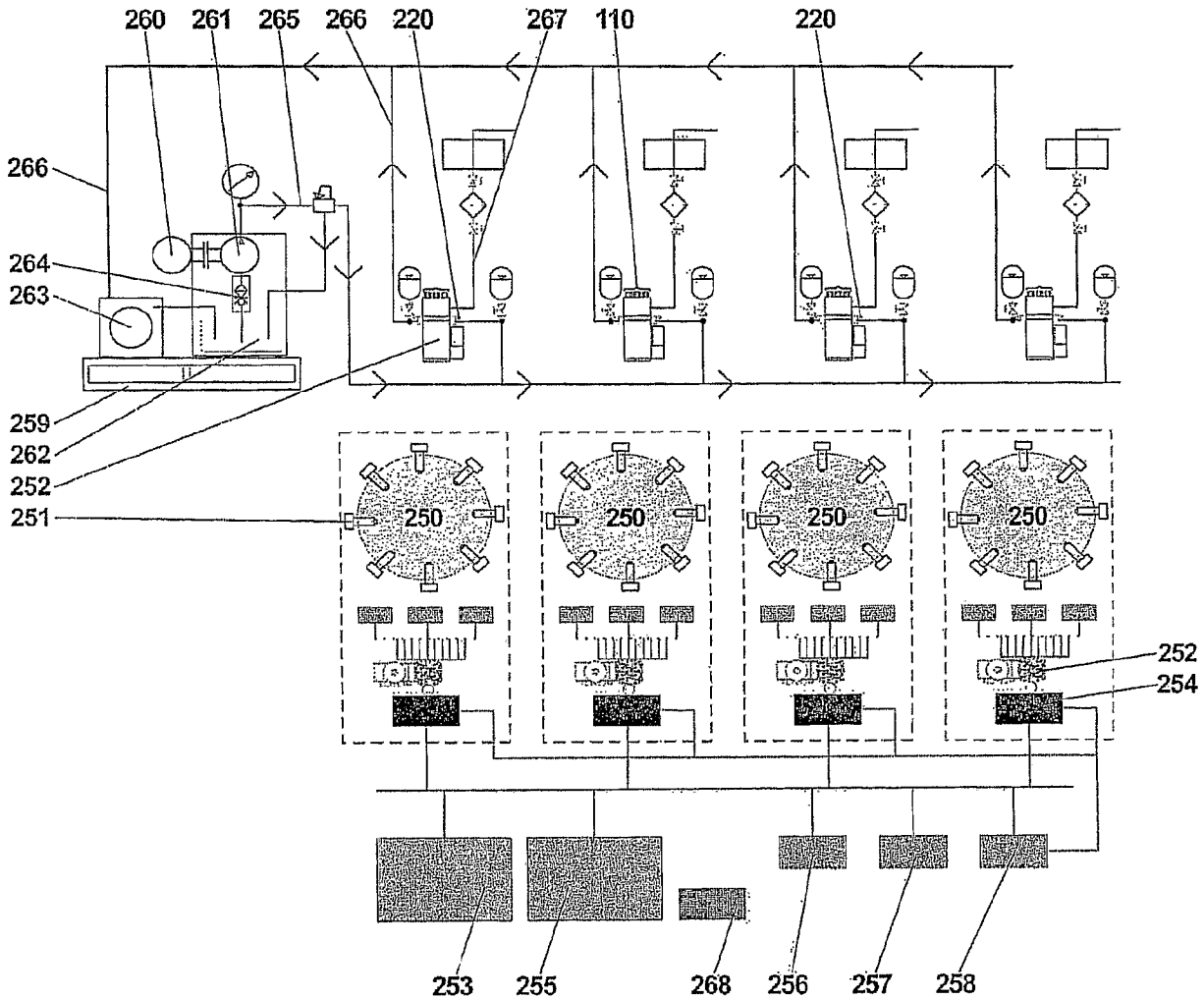
FIG. 12 shows a schematic overview of a system with a plurality of lubricating apparatuses for use by a method according to the invention.
Figure 13:
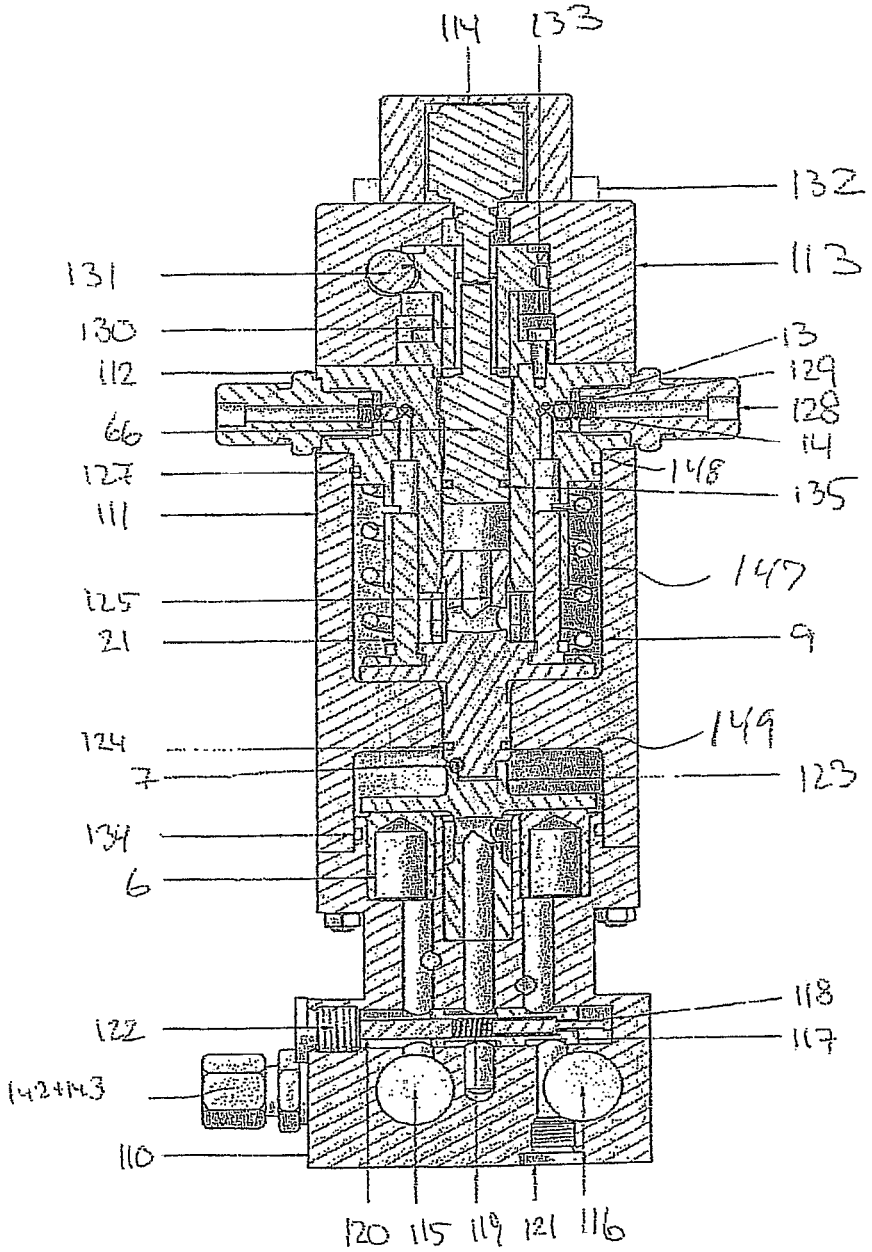
FIG. 13 shows a sectional view through an embodiment of a lubricating apparatus for use by a method according to the invention.

FIGS. 12 and 13 describe designs that are known per se from the above mentioned EP 2 044 300.

FIG. 12 shows schematically four cylinders 250 and on each cylinder appears eight injection nozzles 251. The lubricating apparatuses 252 are connected with a central computer 253, with local control units 254 typically for each single lubricating apparatus 252. The central computer 253 is coupled in parallel with a further control unit 255 constituting a backup for the central computer. In addition, there is established a monitoring unit 256 monitoring the pump, a monitoring unit 257 monitoring the load and a monitoring unit 258 monitoring the position of the crankshaft.

In the upper part of FIG. 1 there is shown a hydraulic station 259 comprising a motor 260 driving a pump 261 in a tank 262 for hydraulic oil. The hydraulic station 259 furthermore includes a cooler 263 and a filter 264. System oil is pumped via supply line 265 on to the lubricating apparatus via a valve 220. The hydraulic station is furthermore connected with a return line 266 which is also connected with the lubricating apparatus via a valve.

Lubricating oil is forwarded to lubricating apparatus 252 via a line 267 from a lubricating oil supply tank (not shown). The lubricating oil is forwarded from the lubricating apparatus via lines 110 to the injection nozzles 251.

Via the local control units, one may regulate both the lubricating oil amount (in the shape of frequency and stroke) and the timing of the injection. On the basis of various lubricating oil regulation algorithms (e.g. load-dependent lubricating oil reduction) and distribution keys for injection times (thereby varying the ratio between supply of first, second and third parts), by changed conditions of operation the regulation of injection time and amount may be performed automatically. These changes may be performed on the basis of engine load and condition, and either directly or indirectly on the basis of parameters essential for the cylinder condition (for example revolutions, cylinder lining temperature, engine load, injected fuel amount, lubricating oil quality, lubricating oil viscosity, TBN content of lubricating oil, analysis results for scavenge drain oil (residual TBN, Fe-content etc.).

FIG. 13 shows an embodiment of a lubricating apparatus for use by a method according to the invention.

The lubricating apparatus is made up of a bottom part 110 where solenoid valves 115 and 116 for activating the apparatus are mounted. At the side of the bottom part 110, screw joints are provided for system oil pressure supply 142 and system oil pressure return to tank 143.

The driving oil may be supplied through two solenoid valves, of which one is a primary solenoid valve 116 and the other is a secondary solenoid valve 115.

In the initial position, it is the primary solenoid valve 116 which is active. The driving oil is hereby conducted from the associated supply screw joint 142 to the primary solenoid valve 116 and via a switch valve 117 into the apparatus through a distribution channel 145 to the group of associated hydraulic pistons.

In case that the primary solenoid valve 116 fails it is possible automatically to connect the secondary solenoid valve 115. This valve is connected by activating the secondary solenoid valve 115.

The associated distribution channel 146 is hereby pressurised. This pressure entails that the switch valve 117 is displaced to the right, whereby the connection between the primary solenoid valve 116 and the associated distribution channel 145 is interrupted. The pressure is hereby removed from the hydraulic pistons connected to this solenoid valve 116.

By activating the secondary solenoid valve 115, the associated distribution channel 146 and the associated hydraulic pistons are pressurised. This causes that the distribution plate 7 is then driven by the oil conducted into the apparatus via the secondary solenoid valve 115.

The switch valve 117 may be equipped with a spring 119. In case of lack of supply pressure through the secondary solenoid valve, the spring will thus automatically put the switch valve 117 back to the above initial position.

The switch valve may be equipped with a restrictor so that this returning of the switch valve can be delayed. In this way is avoided/restricted that the switch valve 117 goes back and forth between the activations. On FIG. 12, the restriction is determined by a slot formed between a drain-pin 118 and the switch valve 117.

When each of the solenoid valves is connected to a separate group of hydraulic pistons, independence between the solenoid valves is ensured. When shifting between the primary solenoid valve 116 and the secondary solenoid valve 115, the switch valve 117 will ensure that the pressure is removed from the primary group of hydraulic pistons and thereby enable operation of the secondary solenoid valve 115, even in cases where the primary solenoid valve is blocked.

Pos. 121 shows a blanking screw.

Pos. 122 shows a combined blanking screw/end stop that partly act as end stop for the pawl 120 of the switch valve 117 and partly has a sealing function also via a (not shown) packing.

Above the hydraulic pistons 6 there is a distributor plate 7. The plate is shown here as a two-part design with an upper distributor plate member 125 and a lower distributor plate member 123. The dosing pistons 21 are mounted in/on the upper distributor plate member 125. In apparatuses where various oils are used for drive and lubrication, there is a piston packing 124 between the upper and lower distributor plate member. In principle, one may also suffice with using one kind of oil for drive oil as well as for lubricating oil.

Around the dosing pistons 21 there is a common return spring 9 which returns the pistons 21 after disconnecting the supply pressure on the hydraulic pistons 6. Around the return spring 9 there is a small lubricating oil reservoir 147 which is externally delimited by a base block 111. The lubricating oil is supplied through a separate screw joint with packings 138 and 139. The apparatus may optionally be equipped with a venting screw with packing 15 and 16.

Above the base block 111 the cylinder block 112 is located where the dosing pistons 21 are disposed for their reciprocating movement. Above the dosing pistons 21 there is a pump chamber 148. In this chamber there is an outlet with a non-return valve ball 13 which is biased by a spring 14. Furthermore, there is provided a screw joint 128 connected directly with the non-return valves/SIP valves in the cylinder wall.

For adjusting the stroke, in this embodiment there is shown an arrangement with a motor 132 coupled to a worm drive 131 which via a worm wheel 130 adjusts the stroke by changing the position on set pin/set screw 66.

In this embodiment, it is possible to adjust the stroke by changing the position of the stroke stop. This is different from the previous embodiment where a fixed point of origin was used and where the stroke was adjusted subsequently.

In order to control the actual stroke length, a sensor/pickup unit 114 is mounted in continuation of set pin/set screw 66 for detecting the stroke, e.g. in the form of an encoder or a potentiometer.

Pos. 113 shows a housing for the set pin/set screw arrangement.

Pos. 124 shows a piston packing sealing between the two spaces 149 and 147 with leak oil bypassing the hydraulic pistons 6 at the drive oil side at the bottom and the lubricating oil at the top, respectively.

Pos. 127 shows an O-ring sealing between the base block 111 and the cylinder block 112.

Pos. 133 shows a fastening screw for fastening a bearing case for the worm wheel 130.

Pos. 134 shows an O-ring sealing between the bottom plate 110 and the base block 111.

The invention claimed is:

1. A method for lubricating cylinders in large diesel engines, where injection of lubricating oil is performed via a number of injection units corresponding to a multiple of the cylinder number in the engine, where the lubricating oil is supplied as a combination of injection of at least two parts of the lubricating oil, where said at least two parts of lubricating oil is delivered in at least two different piston positions, where the at least two different piston positions are selected among piston positions for injecting before, during and after the passage of the piston by the injection unit, and where the lubricating oil is supplied by injection directly on a ring area of the wall of the cylinder, wherein the lubricating oil is supplied by a combination of injection of a first part of the lubricating oil above the piston directly on the ring area of the cylinder wall before the passage of the piston, and an injection of a second and/or third part of the lubricating oil, as the second part of the lubricating oil is injected directly on the piston during its passage, and as a third part of the lubricating oil is injected directly on the ring area of the cylinder wall under the piston after passage of the piston, characterized in detection of an indirect or direct parameter for actual cylinder load is performed, and that a distribution between the first and second and/or third parts of the lubricating oil is made such that the second and/or third parts are increased proportionally by reduced cylinder load.

2. Method according to claim 1, wherein the injection of the first part of the lubricating oil is effected in connection with an upward piston passage and at a time immediately before the upward piston passage of the ring area.

3. Method according to claim 1, wherein the injection of the second part of the lubricating oil is effected in connection with an upward piston passage and on an area between the uppermost and the lowermost piston ring of the piston.

4. Method according to claim 1, wherein the same injection units are used for injecting each of the injected parts of the lubricating oil.

5. Method according to claim 1, wherein injection of the first part of the lubricating oil occurs at high pressure through the injection units for establishing a complete or partial atomisation of the lubricating oil and at a time immediately before the upward piston passage of the ring area.

6. Method according to claim 1, wherein injection of the second and/or third part of the lubricating oil occurs at a high pressure through the injection units for establishing a complete or partial atomisation of the lubricating oil.

7. Method according to claim 1, wherein the second and/or third part of the lubricating oil constitutes minimum 10% of the total amount of lubricating oil.

8. Method according to claim 1, wherein the position and movement of the piston are detected directly or indirectly, and that a timing of delivery of the lubricating oil, an adjustment of the amount of lubricating oil and a determination of injection characteristic are performed.

9. Method according to claim 1, wherein it includes a computerised controlling, monitoring and/or detecting of the functions of the method.

10. Method according to claim 1, wherein an electronic control is provided, that the time of oil injecting is used as a parameter for adjusting the distribution of lubricating oil in longitudinal direction of the cylinder, and that the control automatically distributes the different parts of the lubricating oil on the at least two different piston positions.

11. Method according to claim 10, wherein a fixed percentage of the lubricating oil is supplied either on the cylinder piston during its passage by lubricating oil injectors, during either the upward or the downward piston passage; or directly on the cylinder wall under the piston after the piston having passed the lubricating oil injectors during the upwards movement of the piston; or directly on the cylinder wall before the cylinder piston passes the lubricating oil injectors during the downwards movement of the cylinder piston.

12. Method according to claim 10, wherein a fixed amount of the lubricating oil is supplied either on the cylinder piston during its passage by lubricating oil injectors, during either the upward or the downward piston passage; or directly on the cylinder wall under the piston after the piston having passed the lubricating oil injectors during the upwards movement of the piston; or directly on the cylinder wall before the cylinder piston passes the lubricating oil injectors during the downwards movement of the cylinder piston.

13. Method according to claim 10, wherein offline or online wear measurements are performed on the cylinder wall, and that these wear measurements are used for correcting the distribution.

14. Method according to claim 10, wherein offline or online measurements of oil film thickness are performed on the cylinder wall, and that these measurements of oil film thickness are used for correcting the distribution.

15. Method according to claim 10, wherein the distribution between the at least two parts of the lubricating oil is made directly or indirectly depending on the actual sulphur content in the fuel supplied to the cylinder.

16. Method according to claim 1, wherein the large diesel engines are marine engines.

* * * * *